US005967265A

United States Patent [19]

Bruno et al.

[11] Patent Number: 5,967,265

[45] Date of Patent: Oct. 19, 1999

[54] SELF-LEVELING INCLINED LIFT DEVICE

[75] Inventors: Michael Roman Bruno, 4247 W. Beach Rd., Oconomowoc, Wis. 53066; Robert Douglas Bartelt, Hartland, Wis.

[73] Assignee: Michael Roman Bruno, Oconomowoc, Wis.

[21] Appl. No.: 08/747,370

[22] Filed: Nov. 12, 1996

[51] Int. Cl.[6] ..... B66B 9/08

[52] U.S. Cl. ..... 187/201; 187/202

[58] Field of Search ..... 187/200, 201, 187/202

[56] References Cited

U.S. PATENT DOCUMENTS

| | | | |
|---|---|---|---|
| 2,507,887 | 5/1950 | Cheney | 187/201 |
| 4,627,517 | 12/1986 | Bor | 187/201 |
| 5,230,405 | 7/1993 | Bartlet . | |
| 5,476,155 | 12/1995 | Nakatani et al. | 187/201 |

FOREIGN PATENT DOCUMENTS

| | | | |
|---|---|---|---|
| 4272081 | 9/1992 | Japan | 187/201 |

OTHER PUBLICATIONS

Bruno Independent Living Aids, Inc. Dec. 1996 Brochure–Electra–Ride II.

Bruno Independent Living Aids, Inc. Dec. 1995 Model Brochure.

Bruno Independent Living Aids, Inc. Dec. 1996 Brochure–Electra–Ride.

Bruno Independent Living Aids, Inc.—Application Guide for Bruno Stairway Elevator Systems Mar. 1997.

Bruno Independent Living Aids, Inc.—Comfort–Ride AC Stairlift Brochure Dec. 1995.

*Primary Examiner*—Christopher P. Ellis
*Assistant Examiner*—Gregory A. Morse
*Attorney, Agent, or Firm*—Sylke Law Offices; C. Thomas Sylke

[57] ABSTRACT

An inclined lift device for transporting an individual passenger includes a rail, a carriage adapted for being movable along the rail, a drive mechanism coupled to the carriage for moving the carriage along the rail, and a support secured to the carriage for supporting the individual passenger. The rail has at least one retaining surface and a guide surface. The carriage includes a housing pivotally coupled to the rail about an axis spaced from the guide surface, a retaining mechanism pivotally coupled to the housing about the axis and a follower coupled to the housing and spaced from the axis by a predetermined distance. The retaining mechanism engages said at least one retaining surface of the rail to retain the carriage relative to the rail during movement of the carriage along the rail. The follower engages the guide surface to pivot the carriage about the axis based upon a distance between the guide surface and the axis.

20 Claims, 8 Drawing Sheets

SELF-LEVELING INCLINED LIFT DEVICE

BACKGROUND OF THE INVENTION

1. Field of the Invention.

The present invention relates generally to inclined lift devices for individually transporting passengers in ascending and descending directions along a stairway or other inclined surface. More particularly, the present invention relates to an inclined lift device having a passenger support that is maintained at a preselected constant incline while the passenger support is moved along a curved rail or a rail having varying degrees of inclination.

2. Description of the Prior Art.

Inclined lift devices, such as stairway chairlift devices, are utilized for individually transporting persons who have difficulty in ascending or descending stairs and other inclined surfaces. Typical stairway chairlift devices include a track or rail supported along the inclined surface and a carriage with a passenger support driven along the rail so as to ascend or descend the inclined surface. The rail typically guides movement of the carriage up and down the inclined surface. The rail and the carriage also cooperate to maintain the passenger support and the accompanying passenger at a preselected constant incline angle while the passenger moves up or down the inclined surface to protect the passenger from falling off of the passenger support.

Maintaining the passenger support at a constant incline angle has previously required the development of rail structures unique to each particular inclined surface being ascended or descended by the lift device. For example, different rail configurations are typically required to travel up and over landings, around corners and around curves of various stairways. Each unique rail design consequently requires a corresponding unique carriage adapted to move along the rail at a preselected constant incline angle along the rail. As a result, conventional inclined lift devices have required extensive custom made rails and carriages which are expensive to design, build, install, maintain and re-use.

SUMMARY OF THE INVENTION

The present invention is an improved inclined lift device for transporting an individual passenger. The improved inclined lift device includes a rail, a carriage adapted for being movable along the rail, a drive mechanism coupled to the carriage for moving the carriage along the rail, and a support secured to the carriage for supporting the individual passenger. The rail has at least one retaining surface and a guide surface. The carriage includes a housing pivotally coupled to the rail about an axis, a retaining mechanism pivotally coupled to the housing about the axis and a follower coupled to the housing and radially spaced from the axis at by a predetermined distance. The retaining mechanism engages said at least one retaining surface of the rail to retain the carriage relative to the rail during movement of the carriage along the rail. The guide surface engages the follower to pivot the carriage about the axis. Preferably, the guide surface is positioned along the rail so as to maintain a constant preselected angular position of the follower relative to the axis as the carriage moves along varying sections of the rail.

In one preferred embodiment, the carriage is pivotally coupled to the rail by a pivot connection including a track supported by the rail and a pivot member rotatably coupled to the carriage and engaging the track. The pivot member preferably includes a shaft extending from the carriage and a wheel rotating about the axis of the shaft in engagement with the track. Preferably, the track comprises a gear rack and the wheel comprises a spur gear which rotates in engagement with the gear rack. In the most preferred embodiment, the spur gear is driven to move the carriage along the rail.

In another preferred embodiment, the rail includes a horizontal retaining surface and a vertical retaining surface. The retaining mechanism includes a horizontal retaining member and a vertical retaining member. The horizontal retaining member is pivotally coupled to the housing about the axis and engages the horizontal retaining surface of the rail. The vertical retaining member is pivotally coupled to the housing about the axis and engages the vertical retaining surface of the rail. In the most preferred embodiment, the retaining mechanism further includes a yoke pivotally coupled to the housing about the axis for supporting the horizontal retaining member and the vertical retaining member.

DETAILED DESCRIPTION OF THE PREFERRED EMBODIMENTS

Throughout the specification of the application, various terms are used such as "inside", "outside", "upper", "lower", and the like. These terms denote directions with respect to the drawings and are not limitations of orientation of the present invention. Rather, these terms are provided for clarity in describing the relationship between elements of the inclined lift device.

Figure 1:
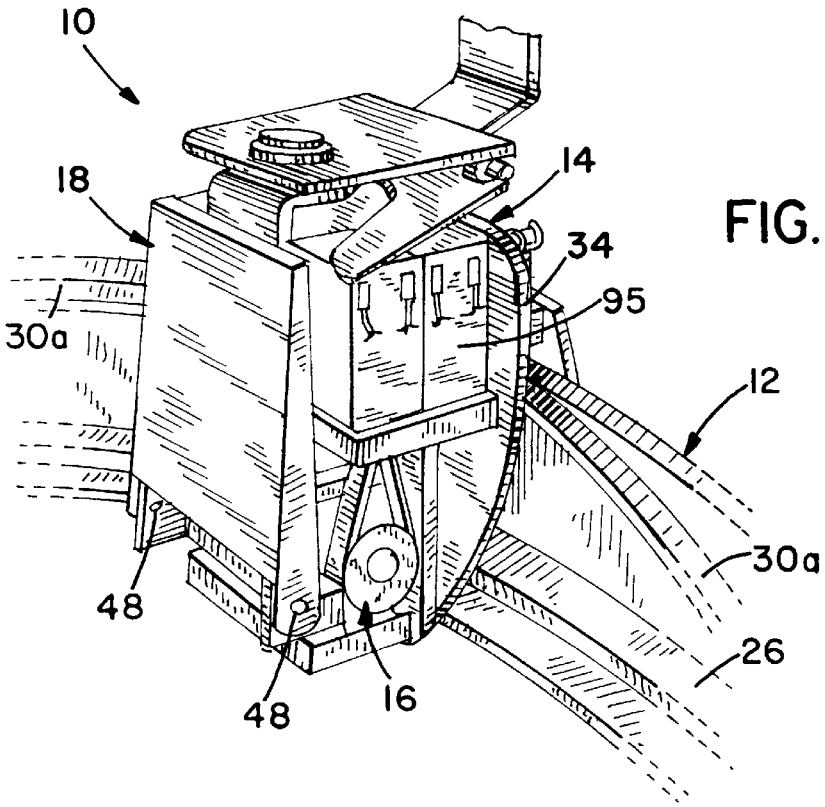
FIG. 1 is a perspective view of an inclined lift device of the present invention including a carriage supported along a curved level section of a rail.
Figure 2:
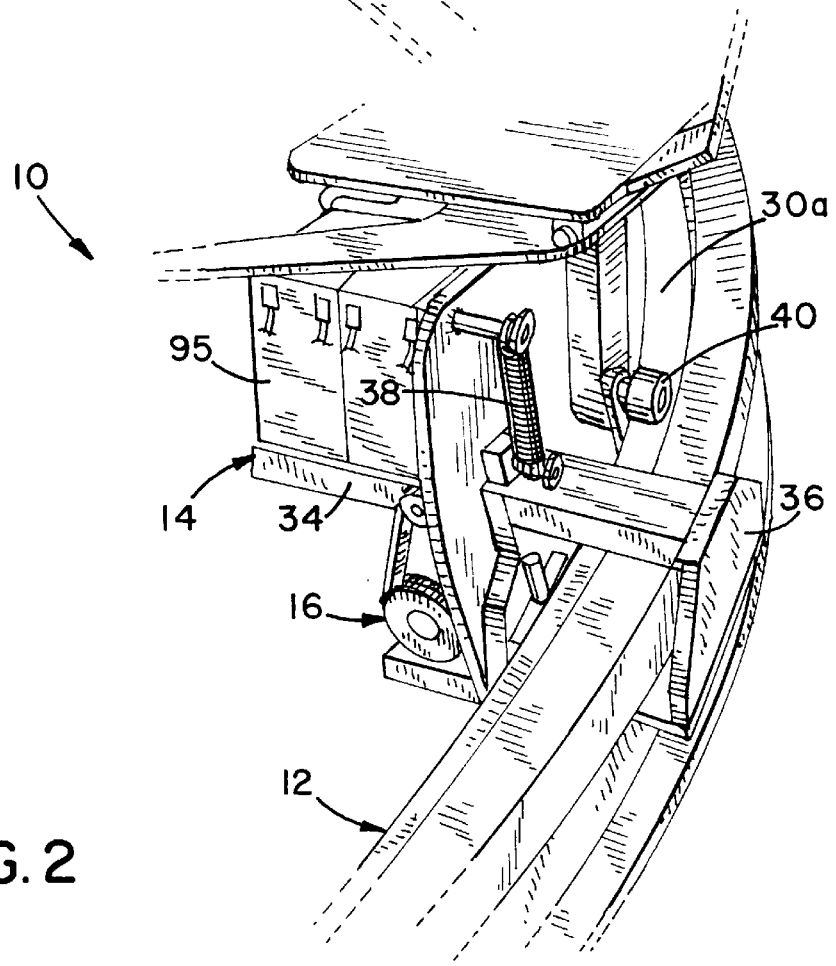
FIG. 2 is a perspective view of the carriage positioned along a curved inclined section of the rail.
Figure 3:
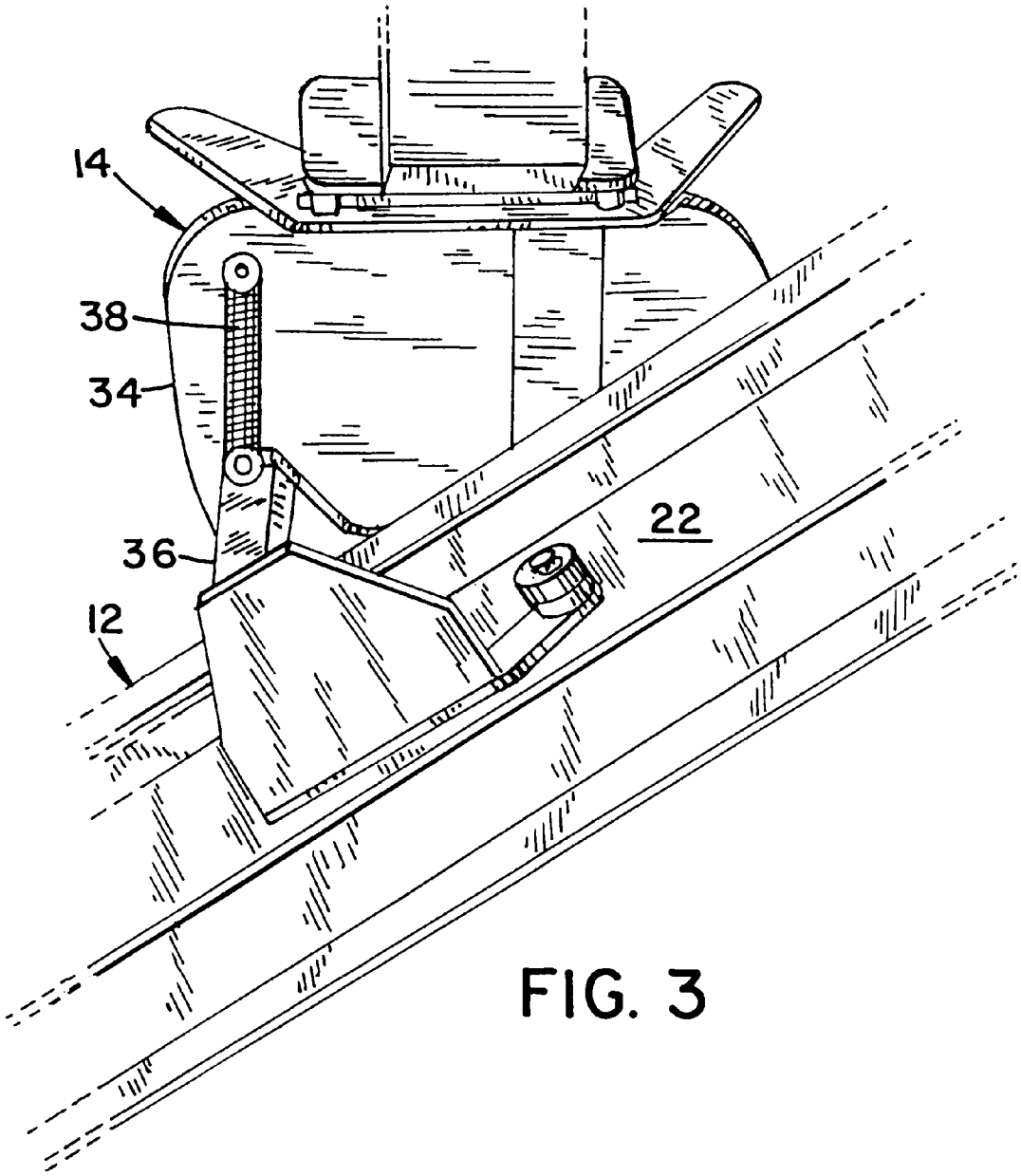
FIG. 3 is a perspective view of the carriage positioned along a straight inclined section of the rail.

FIGS. 1–3 are perspective views illustrating inclined lift device 10 of the present invention. As shown by FIGS. 1–3, inclined lift device 10 generally includes rail 12, carriage 14, drive mechanism 16 and passenger support 18. Rail 12 supports carriage 14 and guides movement of carriage 14 along rail 12 up or down an inclined surface such as a stairway. In particular, FIG. 1 illustrates carriage 14 positioned along a substantially level curved section of rail 12. FIG. 2 illustrates carriage 14 positioned about a curved section of rail 12. FIG. 3 illustrates carriage 14 positioned along an inclined straight section of rail 12. As shown by FIGS. 1–3, rail 12 enables carriage 14 to move along curves or straightaways having varying degrees of inclination.

To support carriage 14, rail 12 includes retaining surfaces 22, 24 (shown in FIG. 4) and 26 As best shown by FIG. 3, retaining surface 22 extends in a general vertical orientation relative to carriage 14 along the length of rail 12. Retaining surface 22 provides a horizontal retaining surface for horizontally retaining carriage 14 relative to rail 12. Retaining surface 24 (shown in FIG. 4) also extends in a general vertical orientation relative to carriage 14. Similar to retaining surface 22, retaining surface 24 provides a horizontal retaining surface for horizontally retaining carriage 14 relative to rail 12. As best shown by FIG. 1, retaining surface 26 extends in a generally horizontal orientation relative to carriage 14 along the length of rail 12. Retaining surface 26 acts as a vertical retaining surface for vertically retaining and supporting carriage 14 relative to rail 14. Although rail 12 is illustrated as including three retaining surfaces for supporting carriage 14, rail 12 may alternatively include any number of surfaces for supporting and guiding movement of carriage 14 along the length of rail 12.

Figure 4:
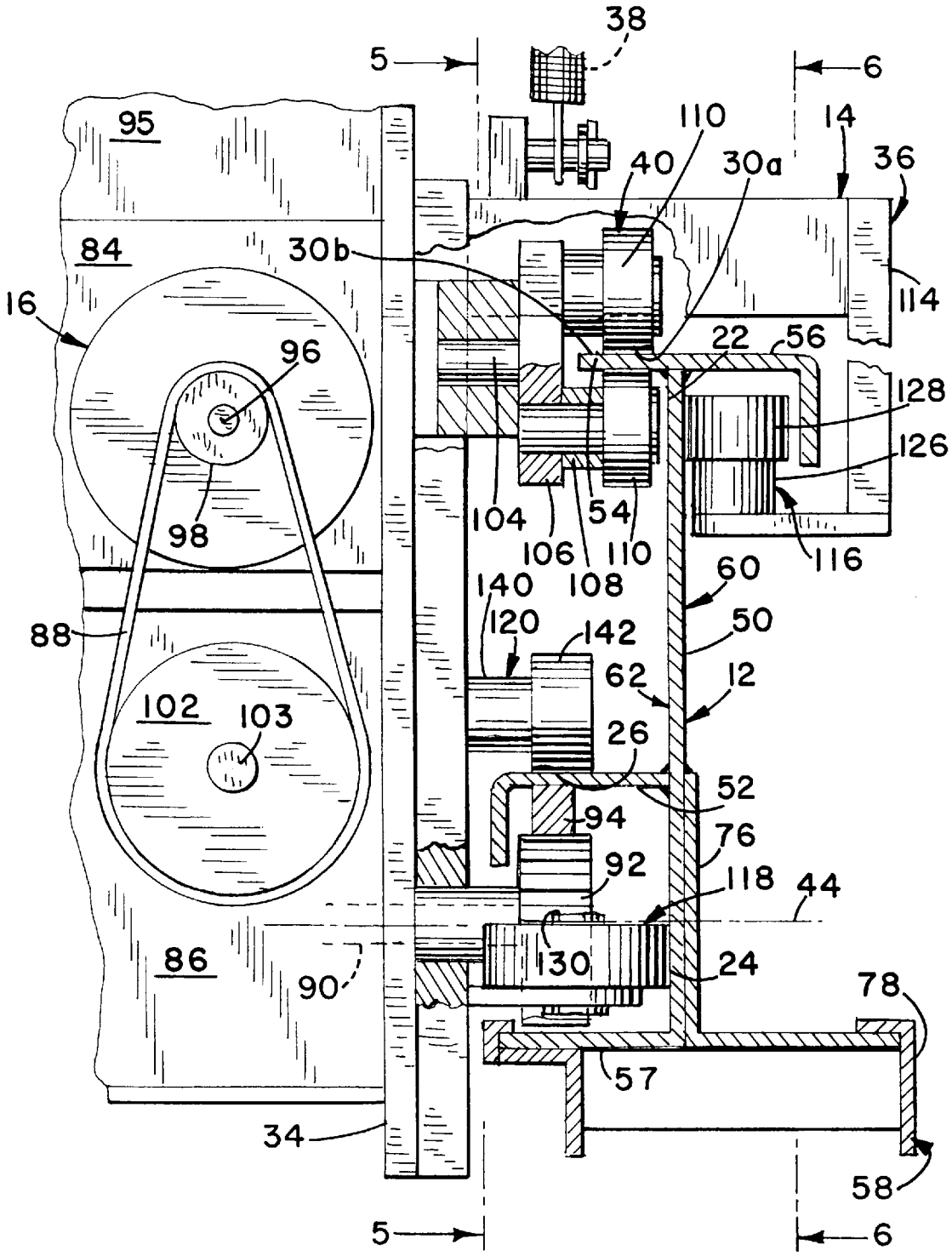
FIG. 4 is the cross sectional view of the inclined lift device with the carriage positioned along a level section of the rail.

As shown by FIGS. 1 and 2, rail 12 also includes guide surfaces 30*a*, 30*b* (shown in FIG. 4). Guide surfaces 30*a*, 30*b* extend along the length of rail 12 in a generally horizontal orientation relative to carriage 14. Guide surfaces 30*a*, 30*b* (shown in FIG. 4) have a slope or a degree of inclination which varies dependent upon the particular slope or degree of inclination of rail 12. Guide surfaces 30 act as a cam surface for controlling the incline angle of carriage 14 relative to rail 12. In the preferred embodiment, guide surfaces 30 maintain carriage 14 in a constant incline angle regardless of whether rail 12 is curved, level or inclined.

Carriage 14 moves along rail 12 and generally includes housing 34, retaining mechanism 36, spring 38 and follower 40. Housing 34 is a generally rigid frame structure which supports passenger support 18. In the preferred embodiment, housing 34 also supports drive mechanism 16. Housing 34 is pivotally coupled to rail 12 so as to pivot about axis 44 (as shown in FIG. 4). As can be appreciated, housing 34 may have a multitude of different configurations and sizes dependent upon the size and configuration of rail 12, drive mechanism 16 and passenger support 18. For example, housing 34 may be alternatively configured so as to substantially enclose and surround drive mechanism 16.

Retaining mechanism 36 is pivotally coupled to housing 34 about axis 44 (shown in FIG. 4) and forcefully engages retaining surfaces 22, 24 and 26 of rail 12 to support and maintain carriage 14 relative to rail 12 while carriage 14 moves along rail 12. Because retaining mechanism 36 is pivotally coupled to housing 34 of carriage 12 about axis 44, retaining mechanism 36 supports carriage 14 relative to rail 12 without affecting the incline angle or vertical orientation of carriage 14 and passenger support 18. As a result, retaining mechanism 36 may be maintained in constant engagement with rail 12 independent of the varying of degrees of inclination of rail 12.

Spring 38 is coupled between housing 34 and retaining mechanism 36. As best shown by FIG. 2, spring 38 has a first end pinned to housing 34 and a second end pinned to retaining mechanism 36. Spring 38 biases retaining mechanism 36 into engagement with rail 12 such that carriage 14 smoothly moves along rail 12 during transitions in rail 12.

Follower 40 is connected to housing 12 and engages guide surfaces 30*a*, 30*b*. Follower 40 serves as a cam follower by engaging at least one of guide surfaces 30*a*, 30*b*. As a result, guide surfaces 30*a*, 30*b* pivot carriage 14 about axis 44. In the preferred embodiment, guide surfaces 30*a*, 30*b* pivot carriage about axis 44 so as to maintain follower 44 at a constant preselected angle relative to axis 44. Consequently, guide surfaces 30*a*, 30*b* correspondingly maintain carriage 14 and passenger support 18 at a constant angle or incline relative to axis 44 as carriage 14 moves along rail 12.

Drive mechanism 16 moves carriage 14 along rail 12. In the preferred embodiment illustrated, drive mechanism 16 is supported by housing 34 to move carriage 14 relative to rail 12. Alternatively, drive mechanism 16 may be housed external from carriage 14 and merely coupled to carriage 14 for movement of carriage 14 along rail 12 by means such as cables, chains and other connection mechanisms.

As best shown by FIG. 1, passenger support 18 is coupled to housing 34 by pins 48. Pins 48 enable passenger support 18 to be folded adjacent to housing 34 when inclined lift device 10 is not being utilized. As can be appreciated, passenger support 18 may alternatively be fixedly coupled to housing 34 and may have anyone of a variety of well-known, conventional configurations for supporting a passenger.

Figure 5:
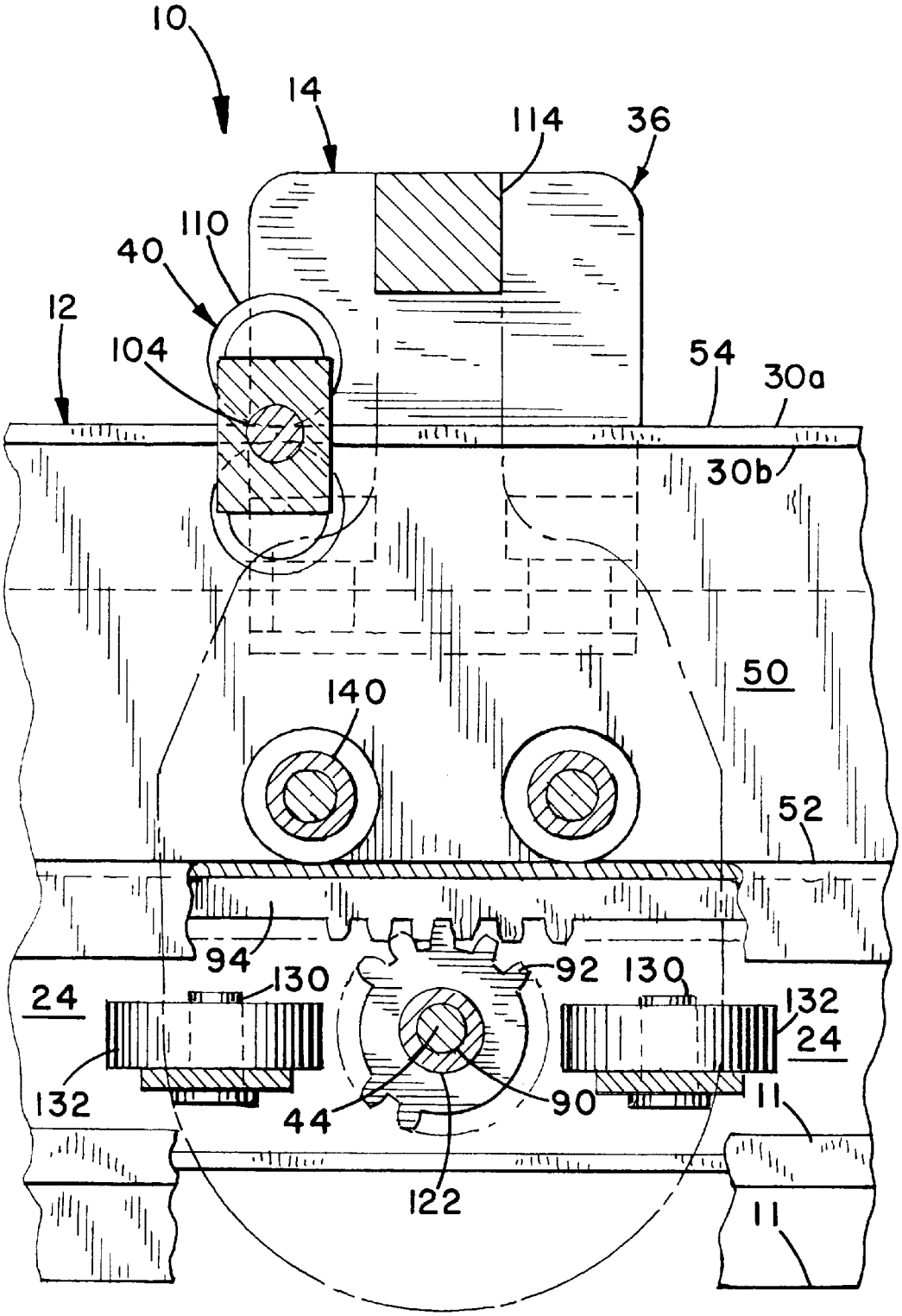
FIG. 5 is a sectional view of the lift device taken along lines 5—5 of FIG. 4.
Figure 6:
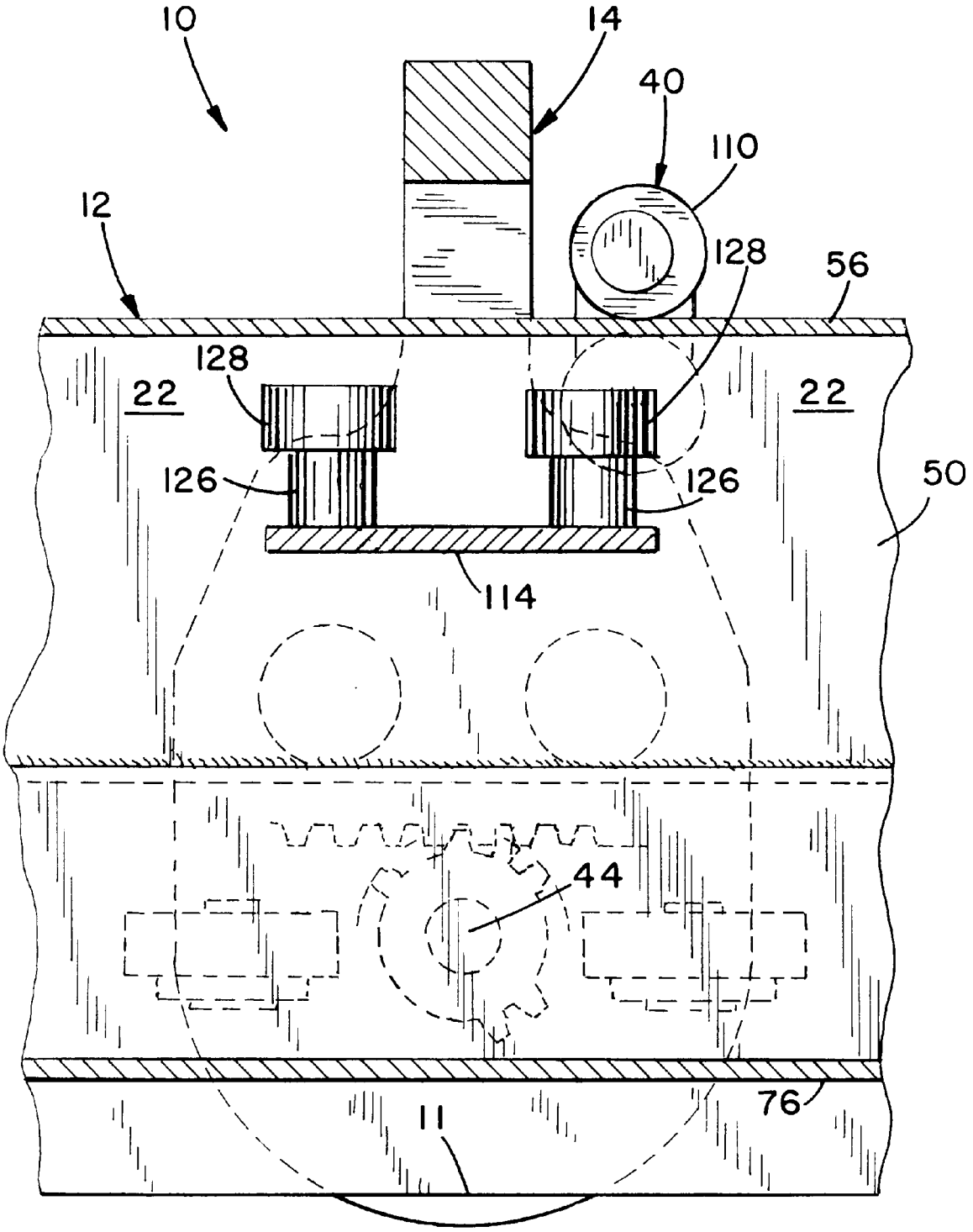
FIG. 6 is a sectional view of the inclined lift device taken along line 6—6 of FIG. 4.

FIGS. 4–6 illustrate rail 12, carriage 14 and drive mechanism 16 in greater detail. FIG. 4 is a cross sectional view of inclined lift device 10. FIG. 5 is a sectional view of inclined lift device 10 taken along lines 5—5 of FIG. 4. FIG. 6 is a sectional view of inclined lift device 10 taken along lines 6—6 of FIG. 4. As best shown by FIG. 4, rail 12 is an elongate generally vertical member having horizontally and vertically extending flanges for providing retaining surfaces 22, 24, 26 and guide surfaces 30*a*, 30*b*.

In the preferred embodiment, rail 12 includes beam 50, support flange 52, guide 54, shields 56,57 and rail mounting supports 58. Beam 50 is a generally vertical member having an outer side 60 and an inner side 62. Outer side 60 extends along a surface of beam 50 opposite carriage 14 and forms retaining surface 22 for engaging retaining mechanism 36. Inner side 62 extends along a side of beam 50 opposite outer side 60 towards carriage 14. Inner side 62 defines retaining surface 24 for engagement with retaining mechanism 36. In addition to providing retaining surfaces 22 and 24, beam 50 supports support flange 52, guide 54, shield 56,57 and rail mounting supports 58. Although beam 50 is illustrated as a generally thin plate-like member, beam 50 may alternatively have a variety of different configurations and dimensions so as to provide retaining surfaces 22 and 24 and so as to support flange 52 and guide 54.

Support flange 52 is a generally horizontal member fixedly mounted to inner side 62 of beam 50 so as to extend from beam 50 towards carriage 14. Support flange 52 provides retaining surface 26 for engaging retaining mechanism 36. Support flange includes a downwardly extending end 64 for partially shielding drive mechanism 16.

Guide 54 is a generally horizontal member extending from inner side 62 of beam 50 towards carriage 14. In the preferred embodiment illustrated, guide 54 comprises a flat strip which is fixedly coupled, preferably by welding, to inner side 62 of beam 50 along the length of rail 12. Guide 54 provides guide surfaces 30*a* and 30*b*. Surfaces 30*a* and 30*b* are radially spaced from axis 44 and extend opposite one another generally perpendicular to inner side 62. Surfaces 30*a* and 30*b* serve as cam surfaces for follower 40. As best shown in FIGS. 7–10, surfaces 30*a* and 30*b* maintain follower 40 at a constant preselected angular position or incline relative to axis 44 independent of the inclination of rail 12.

Shields 56 and 57 protect persons from moving components of lift device 10. Shield 56 is a generally L-shaped member extending from outer side 60 of beam 50 along the length of rail 12. Shield 56 partially surrounds the portion of retaining mechanism 36 in engagement with retaining surface 24 of rail 12. Similarly, shield 57 extends from lower end of beam 50 towards carriage 14 for partially shielding retaining mechanism 36 and drive mechanism 16.

Rail mounting structure 58 extends from the lower end of rail 12 and enables rail 12 to be mounted to an inclined surface such as a stairway (not shown). Rail mounting structure 58 includes mounting members 76,78. Mounting member 76 is a generally L-shaped member welded to outer side 60 of beam 50. Mounting member 78 clamps about mounting member 76 and shield 57 to mount rail 12 to an inclined surface such as a stairway.

As by shown by FIGS. 4 and 5, drive mechanism 16 is supported by housing 34 of carriage 14 and includes motor 84, gear box 86, drive belts 88, output shaft 90, spur gear 92 and rack gear 94. Motor 84 is conventionally known and is mounted within housing 34 of carriage 14. Motor 84 is preferably powered by a DC power source 95 and includes an output shaft 96 connected to drive wheels 98. Drive wheels 98 engage drive belts 88 to transmit power from output shaft 96 of motor 84 to gear box 86.

Gear box 86 is mounted within housing 34 of carriage 14 and is of conventional design. Gear box 86 generally includes drive wheels 102, input shaft 103, and gear mechanism (not shown). Drive wheels 102 of gear box 86 are connected to drive wheels 98 of motor 84 by drive belts 88. Drive wheels 102 are coupled to input shaft 103 which is coupled to output shaft 90 by a conventional gear mechanism (not shown). As a result, power is transmitted from motor 84 to output shaft 90 through gear box 86.

Output shaft 90 has a first end coupled to gear mechanism of gear box 86 and a second end fixedly coupled to spur gear 92. Output shaft 90 extends from gear box 86 and housing 34 through retaining mechanism 36 so as to support spur gear 92 in engagement with gear rack 94.

Gear rack 94 is fixedly coupled to support flange 52 opposite retaining surface 22 along the entire length of rail 12. As conventionally known, gear rack 94 includes a plurality of teeth which engage spur gear 92. As a result, rotation of shaft 90 and spur gear 92 by motor 84 and gear box 86 causes spur gear 92 to move along gear rack 94 and to correspondingly move carriage 14 along rail 12. Because the teeth of spur gear 92 and rack 94 intermesh with another, spur gear 92 and rack gear 94 secure carriage 14 in a selected position along rail 12 upon the cessation of rotation of spur gear 92 by motor 84 and gear box 86. Thus, drive mechanism 16 is capable of moving carriage 14 to positions anywhere along the length of rail 12.

In addition to moving carriage 14 along the length of rail 12, shaft 90, spur gear 92 and rack gear 94 also serve as a pivot connection between carriage 14 and rail 12. As a result, carriage 14 pivots about the axis 44 of shaft 90 and spur gear 92. Within the scope of the contemplated invention are alternative pivot connections utilized in conjunction with external drive mechanisms. For example, carriage 14 may alternatively be driven along rail 12 by an external cable or chain and be pivotally coupled to rail 12 by a wheel which rotates relative to carriage 14 in engagement with a track along rail 12.

As best shown by FIG. 4, follower 40 extends from housing 34 of carriage 14 towards rail 12 and includes carousel shaft 104, carousel 106, follower shafts 108 and follower wheels 110. Shaft 104 is fixedly coupled to housing 34 of carriage 14 and extends towards rail 12. Shaft 104 rotatably supports carousel 106 relative to housing 34.

Carousel 106 is rotatably coupled to housing 34 so as to rotate about the axis of shaft 104. Carousel 106 preferably includes at least one bearing adjacent shaft 104 for rotatably supporting carousel 106 about shaft 104. Carousal 106 supports shafts 108 and follower wheels 110.

Follower shafts 108 are fixedly coupled to carousal 106 and are radially spaced from the center line of shaft 104. Shafts 108 rotatably support follower wheels 110.

Follower wheels 110 are rotatably coupled about follower shafts 108 by conventional bearings (not shown) to enable wheels 110 to freely rotate about the axis of shafts 108. Wheels 110 include outer circumferential surfaces that engage guide surfaces 30*a*, 30*b*. During movement of carriage 14 along rail 12 by drive mechanism 16, follower wheels 110, carried by carousal 106, rotate about shaft 104 as necessary to accommodate changes in the angle of inclination of guide 54. Follower wheels 110 themselves rotate about shafts 108 to provide smooth engagement with guide surfaces 30*a*, 30*b* without incurring high levels of frictional resistance. Because follower wheels 110 engage guide surfaces 30*a*, 30*b*, which are opposite one another, follower 40 constantly and reliably engages guide 54 to pivot carriage 14 about axis 44. As can be appreciated, follower 40 may alternatively have anyone of a variety of configurations for forcefully engaging either or both of guide surfaces 30*a* and 30*b* to pivot carriage 14 about axis 44. For example, follower 40 may alternatively include a single follower wheel 110 rotating about a shaft fixedly coupled to housing 34 and engaging either of surfaces 30*a*, 30*b*. Follower 40 may also alternatively comprise any rigid or resilient member projecting outward from housing 34 in engagement with one or both of surfaces 30*a* and 30*b*.

Retaining mechanism 36 of carriage 14 includes yoke 114 and retaining members 116, 118 and 120. Yoke 114 is a generally U-shaped support which saddles rail 12 as to extend along both outer side 60 and inner side 62 of beam 50. Yoke 114 is pivotally coupled about shaft 84 to housing 34 of carriage 14 by bearing 122 (shown in FIG. 6). Bearing 122 is coupled to yoke 104 about shaft 90 to enable yoke 114 to pivot about axis 44 of shaft 90 and spur gear 92. In the preferred embodiment illustrated, bearing 122 comprises roller thrust bearings. Alternatively, yoke 114 may be pivotally coupled to housing 34 about shaft 90 with roller thrust bearing balls rotatably supported between a first race secured to yoke 114 and a second race secured to housing 34. As can be appreciated, a variety of alternative conventional bearing mechanisms may be employed to rotatably support yoke 114 relative to housing 34 about axis 44.

As best shown by FIG. 6, retaining member 116 is supported by yoke 114 and includes shafts 126 and retaining wheels 128. Shafts 126 are fixedly coupled to yoke 114 and support retaining wheels 128. Retaining wheels 128 are rotatably coupled to shafts 126 so as to rotate about shafts 126 in engagement with retaining surface 22 of rail 12. Because retaining wheels 128 rotate about shaft 126 in engagement with retaining surface 22, retaining member 116 smoothly engages retaining surface 22 with a reduced amount of frictional resistance.

As best shown by FIGS. 4 and 5, retaining member 118 is supported by yoke 114 and includes shafts 130 and retaining wheels 132. Shafts 130 are fixedly coupled to an extending portion of yoke 114 and rotatably support retaining wheels 132 adjacent retaining surface 24 of rail 12.

Retaining wheels 132 are rotatably coupled to shafts 130 so as to rotate about shafts 130 in engagement with retaining surface 24. Because retaining wheels 118 rotate about shafts 130 in engagement with retaining surface 24, retaining member 118 smoothly engages retaining surface 24 with reduced frictional resistance. As a result, carriage 14 more easily moves along the length of rail 12. Although retaining members 116 and 118 have been illustrated as having wheels rotatably supported about shafts in engagement with retaining surfaces 22 and 24, respectively, retaining members 116 and 118 may alternatively comprise any alternative structure which extends from yoke 114 into engagement with retaining surfaces 22 and 24 to maintain yoke 114 and carriage 14 at a preselected horizontal distance from rail 12. Alternatively, retaining members 116 and 118 may comprise any rigid member or resilient member extending from yoke 114 into forceful engagement with retaining surfaces 22 and 24 of rail 12.

As shown by FIG. 4, retaining surfaces 22 and 24 are vertically spaced from one another on opposite sides of rail 12. In particular, retaining surface 22 extends along the length of rail 12 towards an upper end of rail 12 on outer side 60. Retaining surface 24 extends along the length of rail 12 towards a bottom end of rail 12 on inner side 62 of rail 12. Retaining wheels 128 and 132 of retaining members 116 and 118, respectively, correspondingly engage opposite sides of rail 12 at vertically spaced locations. As a result, retaining members 116 and 118 engage retaining surfaces 22 and 24 to horizontally maintain carriage 14 relative to rail 12.

Retaining member 120 extends from yoke 114 in engagement with retaining surface 26 and includes shaft 140 and retaining wheel 142. Shaft 140 is fixedly coupled to yoke 114 and extends from yoke 114 towards rail 12. Shaft 140 rotatably supports retaining wheel 142. Retaining wheel 142 is rotatably coupled to shaft 140 so as to rotate about shaft 140 in engagement with retaining surface 122 of rail 12. In the preferred embodiment, retaining wheel 142 is rotatably supported about shaft 140 by a conventional bearing. As carriage 14 moves along rail 12, retaining wheel 142 rotates about the generally horizontal axis of shaft 140 in engagement with retaining surface 26 to vertically support carriage 14 relative to support flange 52 of rail 12. Because retaining wheel 142 rotates about shaft 140 as carriage 14 moves along rail 12, carriage 14 more smoothly moves along rail 12 with reduced frictional resistance. Alternatively, retaining member 120 may comprise any of a variety of rigid or resilient members extending from yoke 104 in engagement with retaining surface 26 of rail 12.

Figure 7:
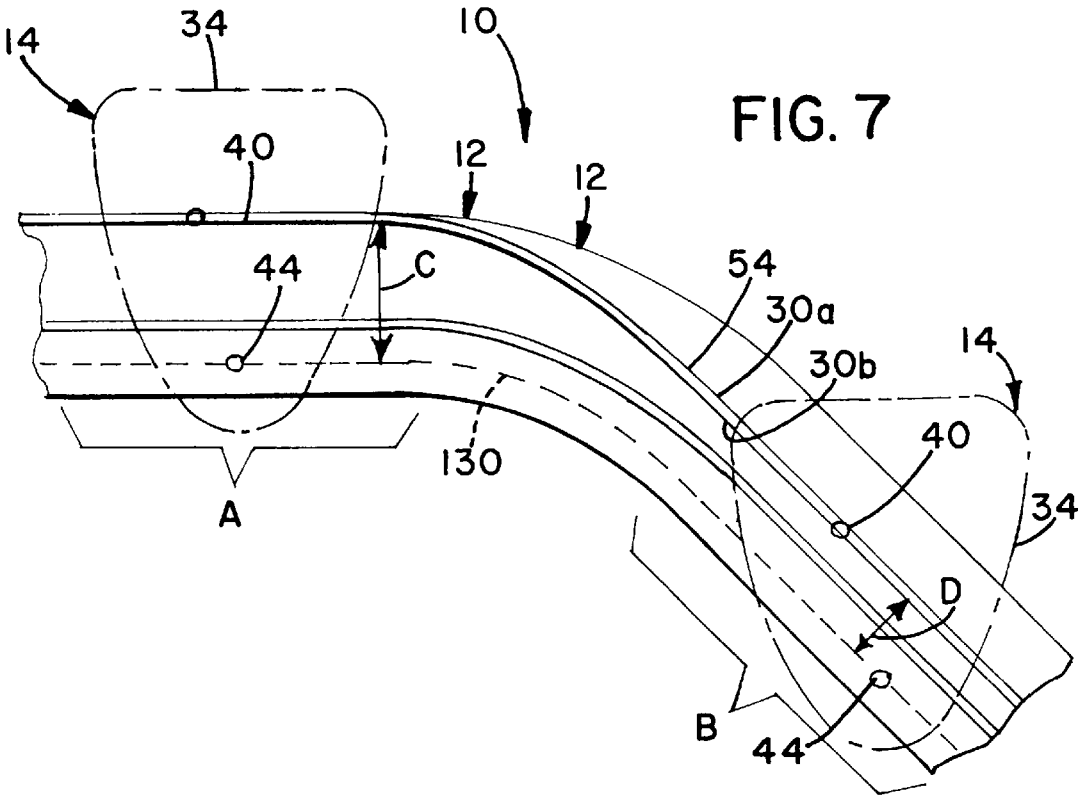
FIG. 7 is a schematic side elevational view of the carriage at various positions along the rail.
Figure 8:
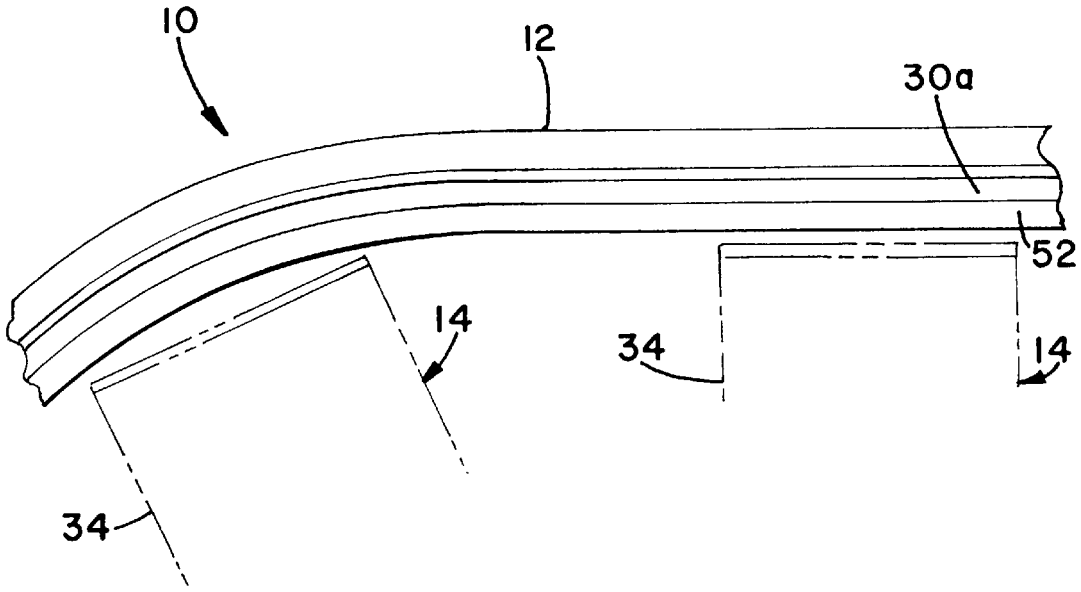
FIG. 8 is a schematic top elevational view of the carriage at various positions along the rail.

FIGS. 7–10 schematically illustrate the movement of carriage 14 along rail 12. In particular, FIGS. 7 and 8 illustrate carriage 14 positioned along sections A and B of rail 14. Section A of rail 14 is a curved horizontal section of rail 14, while Section B is straight inclined section of rail 14. Such a rail would be particularly useful for ascending and descending a stairway having a landing. As best shown by FIG. 7, axis 44 of spur gear 92 (shown in FIGS. 1–6) moves along rack gear 94 following an inclined path 130 (indicated by dashed lines) as drive mechanism 16 moves carriage 14 from section A to section B. At the same time, the distance between guide surfaces 30*a*, 30*b* of guide 54 and path 130 decreases from distance C to distance D to account for the change in slope of path 130 traveled by axis 44. Consequently, guide surfaces 30*a*, 30*b* engage follower 40 to pivot housing 34 of carriage 14 about axis 44 so as to maintain follower 40 at a constant angle relative to axis 44. More specifically, guide surfaces 30*a*,30*b* support follower 40 of carriage 14 at approximately 75 degrees with respect to the horizontal (an 11 o'clock position) while carriage 14 moves along section A of rail 12. At this angular position, follower 40 supports carriage 14 and passenger support 18 (shown in FIG. 1) at approximately zero degrees with respect to the horizontal. In other words, passenger support 18 is level. As carriage 14 descends along section B of rail 12, guide surfaces 30*a*, 30*b* maintain follower 40 at approximately 75 degrees with respect to the horizontal to maintain carriage 14 and passenger support 18 in the level orientation. As can be appreciated, the exact angular position of follower 40 relative to axis 44 required to support carriage 14 and passenger support 18 in the level position will vary depending upon the configuration of carriage 14.

Because guide 54 independently maintains carriage 14 at a constant incline relative to axis 44, adapting a prebuilt rail to a particular inclined surface or stairway having particular changes in slope merely requires adjustment of the spacing between guide 54 and the preselected path 130 of axis 44 along the rail. As a result, standardized sections of rail 12 may be prebuilt. Adapting a prebuilt rail 12 to a particular stairway slope simply requires customizing guide 54 to the particular slope or incline being traversed by rail 12 and securing the customized guide 54 to rail 12. Similarly, preexisting rails may be easily adapted and reused on different inclined surfaces by simply replacing the present guide 54 with a new guide 54 specifically configured for the new inclined surface. As a result, inclined lift device 10 may be more easily and inexpensively designed, built, installed, maintained and reused.

Figure 9:
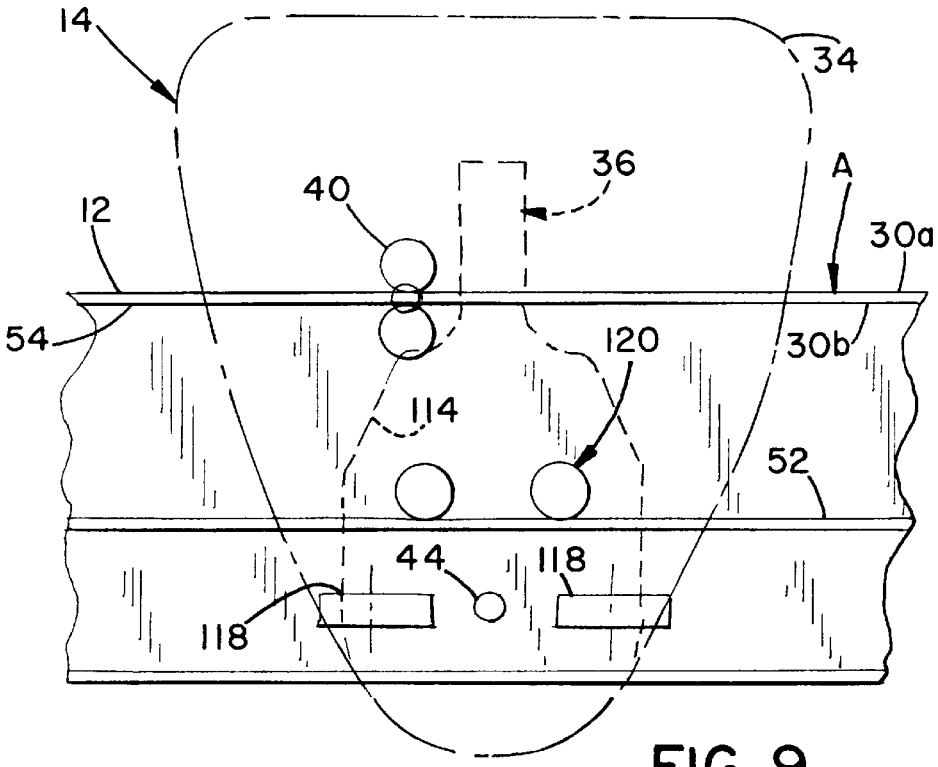
FIG. 9 is a schematic elevational view illustrating the carriage positioned along a level section of the rail.
Figure 10:
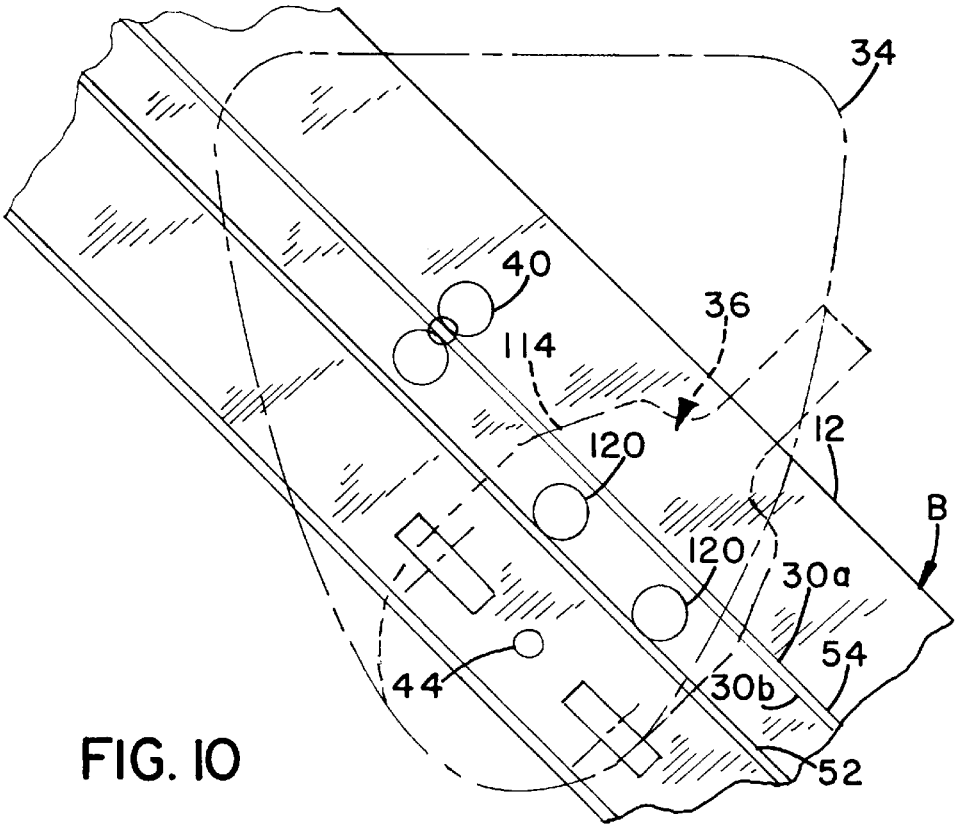
FIG. 10 is a schematic elevational view of the carriage positioned along an inclined section of the rail.

FIGS. 9 and 10 are enlarged schematic views illustrating carriage 14 positioned along sections A and B of rail 12. FIGS. 9 and 10 illustrate retaining mechanism 36 in engagement with rail 12 when carriage 14 is positioned along sections A and B of rail 12, respectively. As shown by FIGS. 9 and 10, yoke 114 of retaining mechanism 36 pivots about axis 44 so that retaining members 116,118 and 120 remain in contact with retaining surfaces 22, 24, and 26, respectively, independent of whether carriage 14 is supported adjacent a curved, straight or inclined section of rail 12. Because yoke 114 pivots about axis 44, which is also the axis about which carriage 14 pivots relative to rail 12, yoke 114 is able to support carriage 14 relative to varying sections of rail 12 without rotating or tipping carriage 14. In addition, because yoke 114 supports carriage 14 adjacent rail 12 independent of the slope or curvature of rail 12, carriage 14 may be prebuilt and utilized on virtually any rail 12 regardless of whether rail 12 is curved, straight, level or at an incline.

Figure 11:
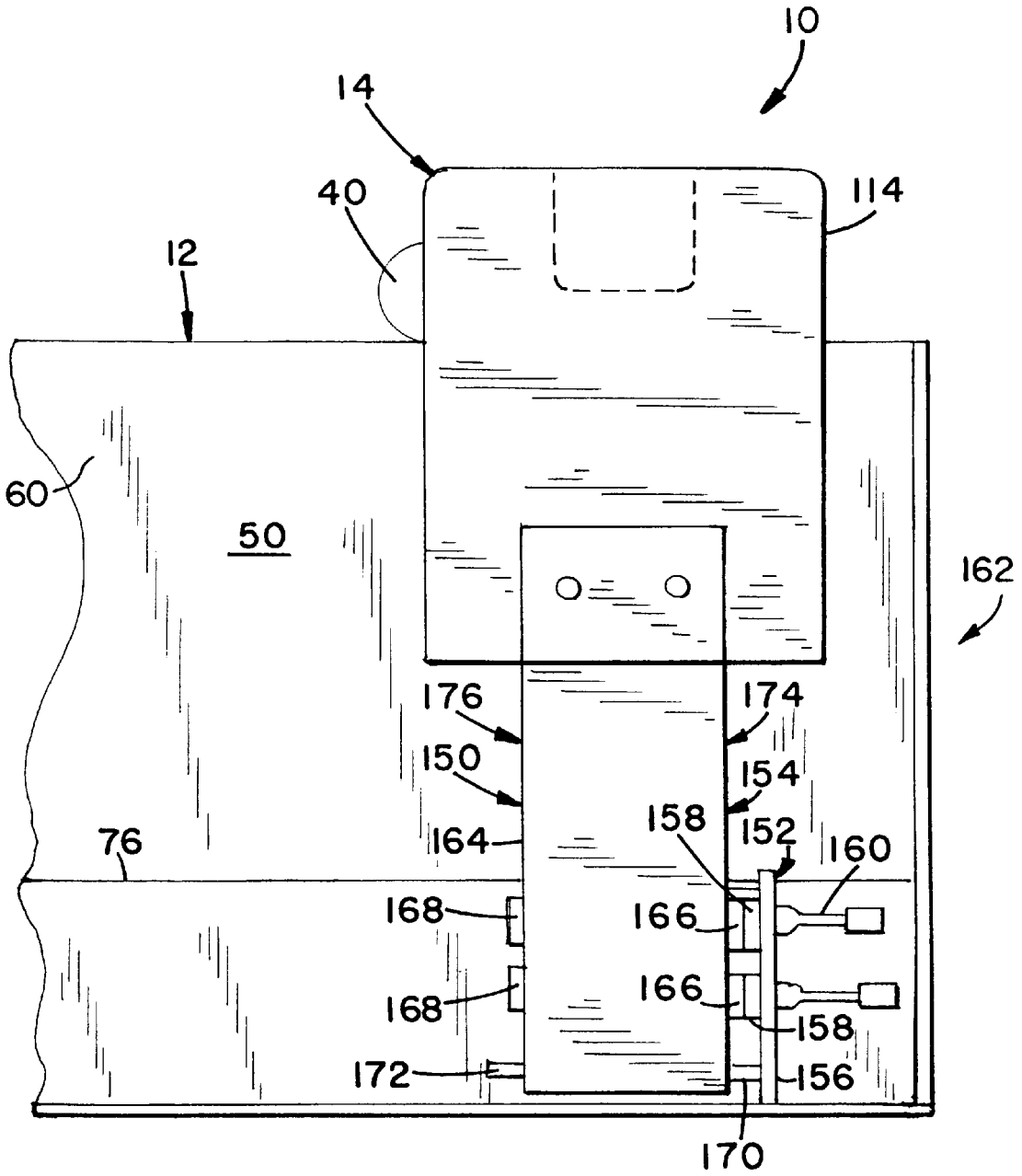
FIG. 11 is a side elevational view illustrating the inclined lift device including a battery charging system.

FIG. 11 is a side elevational view of inclined lift device 10 further including battery charging system 150. Portions of inclined lift device 10 are removed for purposes of illustration. Battery charging system 150 charges battery 95 of carriage 14 when carriage 14 is positioned at either end of rail 12. Battery charging system 150 includes a lower charging dock 152, an upper charging dock (not shown) and a carriage extension 154. Lower charging dock 152 is mounted to rail 12 and includes support 156, charging contacts 158 and power couplings 160. Support 156 is a generally vertical plate fastened to a lower portion of rail 12 near end 162 of rail 12. Preferably, support 156 is bolted to mounting member 76 of rail 12. Support 156 supports charging contacts 158 and power couplings 160.

Charging contacts 158 are conventionally known and are of the type disclosed in U.S. Pat. No. 5,230,405, assigned to Michael Roman Bruno (herein incorporated by reference). Charging contacts 158 are mounted to support 156 for making electrical contact with carriage extension 154.

Charging contacts 158 are electrically coupled to power couplings 160. Power couplings 160 are conventionally known and have a first end electrically connected to charging contacts 158 and a second end configured to be connected to a power source for charging battery 95 (shown in FIG. 1). Although not shown, a second charging dock identical to charging dock 152 is positioned adjacent rail 12 at an end of rail 12 opposite end 162.

Carriage extension 154 is coupled to carriage 14 and moves along rail 12 with carriage 14. Carriage extension 154 includes extension bar 164, charging contacts 166, 168 and terminal sensors 170, 172. Extension bar 164 is a generally rectangular bar secured to yoke 114 of carriage 12. In the preferred embodiment illustrated, extension bar 164 is bolted to yoke 114 proximate outer side 60 of beam 50. Extension bar 164 extends from yoke 114 and supports charging contacts 166, 168 and terminal sensors 170, 172.

Charging contacts 166, 168 are of the type disclosed in U.S. Pat. No. 5,230,405, assigned to Michael Roman Bruno (herein incorporated by reference). Charging contacts 166 are secured to the first side 174 of extension bar 164 in alignment with charging contacts 158. In the preferred embodiment, contacts 166 and 168 are supported perpendicular to the axis of rail 12. Charging contacts 166 are electrically coupled in a conventionally known manner to battery 95 (shown in FIG. 1) of carriage 14. Charging contacts 166 make electrical contact with charging contacts 158 to transmit power from charging dock 152 through carriage extension 154 to battery 95 (shown in FIG. 1) when carriage 14 is positioned adjacent end 162 of rail 12.

Charging contacts 168 are identical to charging contacts 166 and are secured to second side 176 of extension bar 164 so as to make contact with corresponding charging contacts of the upper charging dock (not shown) charging contacts 168 are electrically coupled in a conventionally known manner to battery 95. Charging contacts 168 transmit power from the upper charging dock through charging extension 150 to battery 95 (shown in FIG. 1) when carriage 14 is docked at the opposite end of rail 12. As a result, battery 95 is charged while carriage 14 is docked at charging dock 152 adjacent end 162 of rail 12 or while carriage 14 is docked at a similar charging dock located at an opposite end of rail 12.

Because yoke 114 supports carriage extension 154 and charging contacts 166, 168, charging contacts 166, 168 also pivot about axis 44 (shown in FIG. 4) based upon the incline of rail 12. Consequently, yoke 114 pivots to maintain faces of charging contacts 166, 168 at a constant angle with respect to the axis of rail 12 independent of the inclination angle of rail 12. This helps to ensure correct alignment of charging contacts 166, 168 with charging contacts of the upper and lower docks.

Terminal sensors 170 and 172 extend from support 164. Terminal sensor 170 is positioned so as to engage dock support 156 when carriage 14 is docked adjacent dock 152. Terminal sensor 170 senses when carriage 14 is in a docked position relative to dock 152. Based upon sensed data from terminal sensor 170, lift device 10 generates a signal indicating whether or not carriage 14 is fully docked with dock 152 so as to charge battery 95. Terminal sensor 172 performs similarly to terminal sensor 170 and senses when carriage 114 is docked adjacent the upper charging dock located on an opposite end of rail 12. Thus, charging system 150 ensures that battery 95 remains charged for utilization during power outages.

Variations, modifications and other applications will become apparent to those presently of ordinary skill in the art. Therefore, the above description of the preferred embodiment is to be interpreted as illustrative rather than limiting. The scope of the present invention is limited only by the scope of the claims which follow.

What is claimed is:

1. An inclined lift device for transporting an individual passenger, the device comprising a rail and a carriage movable along said rail;

(1) said rail comprising
- (a) a support beam having generally parallel opposing faces;
- (b) a first flange perpendicular to the faces of said beam; and
- (c) a second flange perpendicular to the faces of said beam;

(2) said carriage comprising:
- (a) a housing comprising drive means coupling said housing to said rail and permitting rotation of said housing about an axis extending horizontally from said housing;
- (b) guide means for maintaining said housing at a preselected angular orientation, said guide means comprising a follower; and
- (c) retaining means for supporting said housing on said rail, said retaining means being pivotally coupled to said axis and comprising a yoke having beam retaining means engaging said beam;

wherein said drive means engages said first flange;

wherein said follower engages said second flange.

2. The lift device of claim 1 wherein said yoke of said retaining means also has flange retaining means engaging said first flange.

3. The lift device of claim 2 wherein said beam retaining means comprises first beam retaining means and second beam retaining means, wherein said first and second beam retaining means respectively engage opposite faces of said beam.

4. The lift device of claim 3 wherein said first flange is a horizontal flange having upper and lower surfaces and said drive means comprises a rack mounted to the lower surface of said first flange.

5. The lift device of claim 4 wherein said flange retaining means engages the upper surface of said first flange.

6. The lift device of claim 5 wherein said first beam retaining means is immediately adjacent said axis.

7. The lift device of claim 6 wherein said first beam retaining means comprises first and second resilient wheels horizontally equidistant from said axis; further wherein said second beam retaining means comprises first and second resilient wheels horizontally equidistant from said axis; and further wherein said flange retaining means comprises first and second resilient wheels horizontally equidistant from said axis.

8. The lift device of claim 1 wherein said first flange is a horizontal flange having upper and lower surfaces and said drive means comprises a rack mounted to the lower surface of said first flange and a pinion rotatably mounted to said housing about said axis.

9. The lift device of claim 8 wherein said flange retaining means engages the upper surface of said first flange.

10. The lift device of claim 9 wherein said first beam retaining means comprises first and second resilient wheels horizontally equidistant from said axis; further wherein said second beam retaining means comprises first and second resilient wheels horizontally equidistant from said axis; and further wherein said flange retaining means comprises first and second resilient wheels horizontally equidistant from said axis.

11. An inclined lift device for transporting an individual passenger, the device comprising a rail and a carriage movable along said rail;

(1) said rail comprising:

(a) a vertical support beam;

(b) a first horizontal flange having upper and lower surfaces; and (c) a second horizontal flange;

(2) said carriage comprising:

(a) a housing comprising drive means coupling said housing to said rail and permitting rotation of said housing about an axis extending horizontally from said housing and perpendicular to said vertical beam;

(b) guide means for maintaining said housing at a preselected angular orientation, said guide means comprising a follower; and (c) retaining means for supporting said housing on said rail, said retaining means being pivotally coupled to said axis and comprising a yoke having vertical retaining means;

wherein said vertical retaining means engages said vertical beam;

wherein said drive means engages said first horizontal flange;

wherein said follower engages said second horizontal flange.

12. The lift device of claim 11 wherein said yoke of said retaining means also has horizontal retaining means that engages said first horizontal flange.

13. The lift device of claim 12 wherein said vertical retaining means comprises a first vertical retaining means and a second vertical retaining means, wherein said first and second vertical retaining means engage opposite sides of said vertical beam at different vertical levels on said beam.

14. The lift device of claim 13 wherein said drive means comprises a rack mounted to the lower surface of said first horizontal flange and a pinion rotatably mounted to said housing about said axis.

15. The lift device of claim 14 wherein said horizontal retaining means engages the upper surface of said first horizontal flange.

16. The lift device of claim 15 wherein said first vertical retaining means is immediately adjacent said axis.

17. The lift device of claim 16 wherein said first vertical retaining means comprises first and second resilient wheels horizontally equidistant from said axis; further wherein said second vertical retaining means comprises first and second resilient wheels horizontally equidistant from said axis; and further wherein said horizontal retaining means comprises first and second resilient wheels horizontally equidistant from said axis.

18. The lift device of claim 11 wherein said drive means comprises a rack mounted to the lower surface of said first horizontal flange and a pinion rotatably mounted to said housing about said axis.

19. The lift device of claim 18 wherein said horizontal retaining means engages the upper surface of said first horizontal flange.

20. An inclined lift device for transporting an individual passenger, the device comprising a rail and a carriage movable along said rail;

(1) said rail comprising:

(a) a vertical support beam;

(b) a first horizontal flange having upper and lower surfaces; and (c) a second horizontal flange;

(2) said carriage comprising:

(a) a housing comprising drive means coupling said housing to said rail and permitting rotation of said housing about an axis extending horizontally from said housing and perpendicular to said vertical beam, wherein said drive means comprises a rack mounted to the lower surface of said first horizontal flange and a pinion rotatably mounted to said housing about said axis;

(b) guide means for maintaining said housing at a preselected angular orientation, said guide means comprising a follower;

(c) retaining means for supporting said housing on said rail, said retaining means being pivotally coupled to said axis and comprising a yoke having a vertical retaining means and a horizontal retaining means;

wherein said vertical retaining means engages said vertical beam;

further wherein said horizontal retaining means engages the upper surface of said first horizontal flange;

further wherein said follower engages said second horizontal flange;

further wherein said drive means engages said first horizontal flange;

further wherein said vertical retaining means comprises a first vertical retaining means immediately adjacent said axis and a second vertical retaining means, wherein said first and second vertical retaining means engage opposite sides of said vertical beam further wherein said first vertical retaining means comprises first and second resilient wheels horizontally equidistant from said axis;

further wherein said second vertical retaining means comprises first and second resilient wheels horizontally equidistant from said axis; and further wherein said horizontal retaining means comprises first and second resilient wheels horizontally equidistant from said axis.

* * * * *